United States Patent [19]

Templeton

[11] Patent Number: 4,913,169

[45] Date of Patent: Apr. 3, 1990

[54] SMOKING ARTICLE

[75] Inventor: Leroi K. Templeton, Louisville, Ky.

[73] Assignee: Brown & Williamson Tobacco Corporation, Louisville, Ky.

[21] Appl. No.: 325,330

[22] Filed: Mar. 17, 1989

[51] Int. Cl.[4] ..... A24D 3/04

[52] U.S. Cl. ..... 131/194; 131/359; 131/361; 131/364

[58] Field of Search ..... 131/198 R, 198.1, 359, 131/361, 364, 194

[56] References Cited

U.S. PATENT DOCUMENTS 3,774,622 11/1973 Steigerwald ..... 131/198.2

4,474,191 10/1984 Steiner ..... 131/198.2

*Primary Examiner*—V. Millin

*Attorney, Agent, or Firm*—Charles G. Lamb

[57] ABSTRACT

A smoking article includes a fuel rod, an insulation section at one end of the fuel rod, a tobacco plug at the end of the insulation return, a cooling chamber at the end of the insulation section, and a filter at the end of the chamber. A tube extends concentrically through the fuel rod to the tobacco plug. The tube is filled with an air permeable substrate including an aerosol generating substance. A heat conducting strip extends concentrically in the substrate in the tube and into the tobacco plug.

17 Claims, 1 Drawing Sheet

SMOKING ARTICLE

BACKGROUND OF THE INVENTION

The present invention relates to smoking articles and more particularly to improvements to smoking articles of the type which contain a non-combustible material circumscribed by a fuel rod, wherein the non-combustible material includes an aerosol generating substance. Even more particularly, the present invention provides a smoking article with improved heat conducting means for vaporizing the aerosol generating substance.

Various smoking articles of the type having a concentric tube extending through a fuel rod with a substrate including an aerosol generating substance are per se known.

Examples of such smoking articles are shown in U.S. Pat. No. 3,258,015 issued on June 28, 1966 to C. D. Ellis et al, and U.S. Pat. No. 3,356,094 issued on Dec. 5, 1967 to C. D. Ellis, et al.

SUMMARY OF THE INVENTION

The present invention provides a smoking article including a generally cylindrically shaped fuel rod, a first generally cylindrically shaped first insulation section coaxially located at one end of the fuel rod, and a second generally cylindrically shaped insulation section coaxially located at the end of the first insulation section. A tobacco plug is coaxially located at the end of the tobacco plug and a cooling chamber is coaxially located at the end of the tobacco plug. A tube of heat conductive material extends concentrically through the fuel rod, first insulation section, and second insulation section and terminates at the interface of the second insulation section and tobacco plug. The tube is filled with an air permeable substrate including an aerosol generating substance. A heat conducting member extends concentrically through the substrate in the tube and into the tobacco plug.

BRIEF DESCRIPTION OF THE DRAWINGS

A better understanding of the present invention will be had upon reference to the following description in conjunction with the accompanying drawings wherein the numerals refer to the parts throughout the several views and in which.

DETAILED DESCRIPTION OF THE PREFERRED EMBODIMENT

Figure 1:
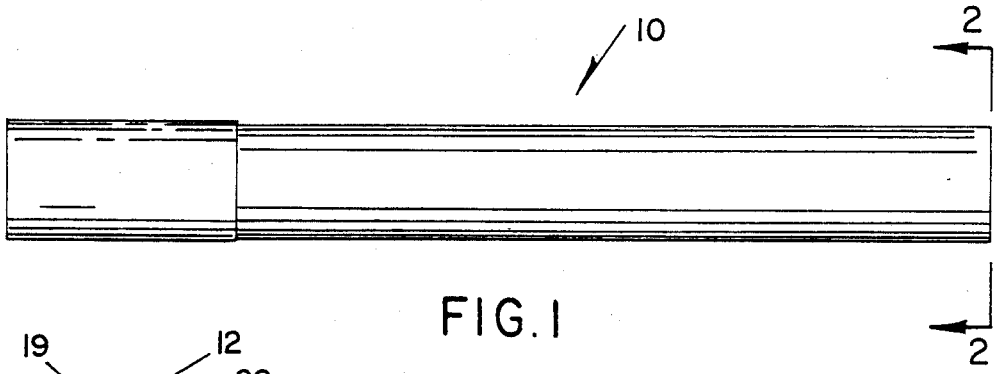
FIG. 1 is a side view of the smoking article of the present invention.
Figure 2:
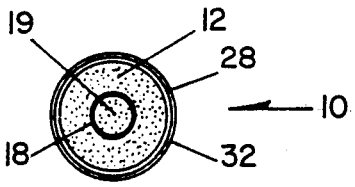
FIG. 2 is a front view of the smoking article of FIG. 1 as seen in the direction of arrows 2—2 in FIG. 1.
Figure 3:
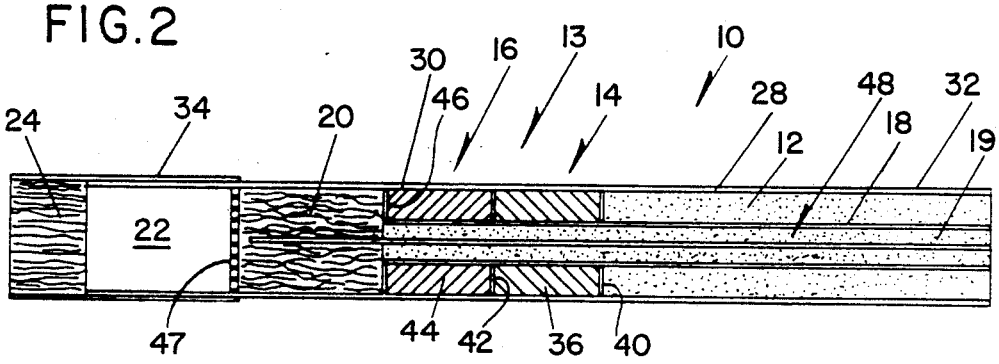
FIG. 3 is a longitudinal cross-sectional view of the smoking article of FIG. 1.

With reference to FIGS. 1–3, there is shown a smoking article, generally denoted as the numeral 10, of the present invention which has the outward appearance of a conventional filtered cigarette.

The smoking article 10 comprises a generally cylindrical fuel rod 12, and a generally cylindrical thermal insulation section 13 located at one end of the fuel rod 12. A tube 18 of heat transferable material extends concentrically through the cylindrical fuel rod 12, and the insulation section 13. The tube 18 is filled with a substrate 19 which includes an aerosol generating substance which may be, for example, glycerin, propylene glycol, or any other aerosol generating means known in the art. A generally cylindrical tobacco plug 20 is coaxially located at the end of the second insulation section 16 opposite the first insulation section 14 and is in flow communication with the tube 18. A chamber 22 is coaxially located at the end of the tobacco plug 20, opposite the second insulation subsection 16 and is in flow communication with the tobacco plug 20. A low efficiency gas separation filter rod 24 is shown as being coaxially located at the end of the chamber 22 opposite the tobacco plug 20 and is in flow communication with the chamber 22.

As show in FIG. 3, the thermal insulation section 13 includes a first thermal insulation subsection 14 coaxially located at one end of the fuel rod 12 and a second thermal insulation subsection 16 coaxial with the first thermal insulation subsection 14.

With reference to FIGS. 2 and 3, the fuel rod 12 is circumferentially wrapped by a layer of heat insulation material 28, such as, for example, carbon matting or the like. The first insulation subsection 14, second insulation subsection 16, tobacco plug 20, and chamber 22 are circumscribed by an insulation sleeve 30 on relatively stiff material such as, for example, a thick paper, or ceramic. To give the appearance of a conventional cigarette, the wrapped fuel rod 12, and insulation sleeve 30 can be circumferentially overwrapped by conventional cigarette wrapper paper 32, and the filter rod 24 can be attached by a circumferential tipping material 34 which overlaps the cigarette wrapper paper 32.

The first insulation subsection 14 can include a collar 36 of thermal insulation material, which may be fiberglass, ceramic fibers or the like, circumscribing the tube 18 beneath the sleeve 30. A first heat resistant, air impermeable, annular partition 40 is located at the interface of the collar 36 and the fuel rod 12, and a second heat resistant, air impermeable annular partition 42 is located at the interface of the collar 36 and the second insulation subsection 16. The annular partitions 40 and 42 extend radially between the sleeve 30 and tube 18.

Figure 5:
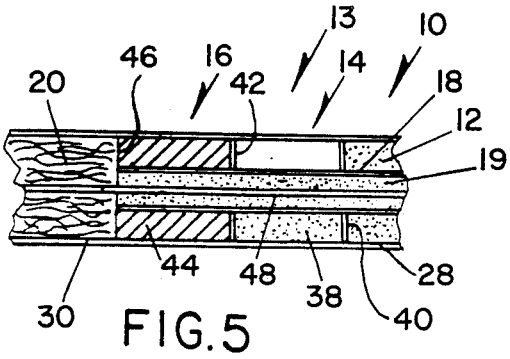
FIG. 5 is a longitudinal cross-sectional view of a portion of the smoking article of FIG. 1 showing an alternative embodiment of a component thereof.

With reference to FIG. 5, the first insulation subsection 14 comprises an annular air space 38 surrounding the tube 18. The insulating air space 38 of the first insulation subsection 14 is defined between the first annular partition 40, the second annular partition 42, the sleeve 30 and the tube 18. The annular partitions 40 and 42 can be fabricated of the same material as the sleeve 30 and can be integrally attached or unitary with the sleeve 30.

With reference to FIG. 3, the second insulation subsection 16 can also include a collar 44, which may be ceramic, fiberglass, or the like, circumscribing the tube 18 beneath the sleeve 30. The collar 44 is disposed between the second annular partition 42 and a third heat resistant, air impermeable, annular partition 46 located at the interface of the collar 44 and the tobacco plug 20. The annular partition 46 extends radially between the sleeve 30 and tube 18 and covers the annular portion of the tobacco plug 20 outside of the perimeter of the tube 18.

A reticulated partition 47 is located across the end of the tobacco rod 24 at the interface thereof with the chamber 22 to prevent tobacco particles from entering the chamber 22 while providing for the flow of air into the chamber 22.

The tube 18 is fabricated of material having a high coefficient of heat transfer. Various materials such as, for example, ceramic and aluminum, can be used as the material for the tube 18.

The air permeable substrate 19 within the tube 18 is a non-combustible material such as, for example, alumina. The substrate material 19 can be formed in the form of a porous rod, granules, pellets, or strands. The substrate 19 must allow the flow of air therethrough along the length of the tube 18. As mentioned previously, the substrate 19 includes an aerosol generating substance which will be aerosolized at the smoldering temperature of the fuel rod 12. One such aerosol generating substance is, for example, glycerine. The aerosol generating material can be in the interstices of the substrate 19, coated on the substrate 19, or absorbed in the substrate 19.

Figure 4:
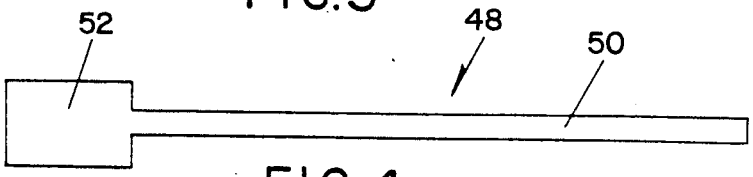
FIG. 4 is a plan view of a component of the smoking article.

With reference to FIGS. 3 and 4, the smoking article 10 includes heat conducting means, generally denoted as the numeral 48, extending through the substrate 19 inside the tube 18 and into the tobacco plug 20. The function of the heat conducting means 48 is to efficiently conduct heat from the substrate 19 in the tube 18 into the interior of the tobacco plug 20 wherein the heat will volatilize the taste components of the tobacco of the tobacco plug 20. The heat conducting means 48 is an enlongated strip of material having a high coefficient of heat transfer. Various materials, such as copper, aluminum, and alloys of copper and aluminum, titanium, or any other well known metallic compound having high heat conductive properties can be used for the heat conducting strip 48. The heat conducting strip 48 is shown as including a first elongated section 50 which is concentrically located in the substrate 19 and extends the entire length of the tube 18, and a second elongated section 52 which is concentrically located in the interior of the tobacco plug 20. The heat conducting strip is flat, that is its thickness dimension is less than its width dimension. In addition, the width dimension of the first section 50 is less than the width dimension of the second section 52.

In operation, the fuel rod 12 is ignited and smolders because no air is drawn through the fuel rod. The heat from the ignited fuel rod 12 is transferred through the wall of the tube 18 to heat the substrate material 19 inside the tube 18 to vaporize the aerosol generating substance. As a smoker inhales or draws on the filtered end of the smoking device 10, ambient air is drawn through the open end of the tube 18 and passes through the substrate 19 to the tobacco plug 20. The air is heated and entrains the vaporized aerosol substance. The heated air with the entrained aerosol substance then passes from the tube 18 into the tobacco plug 20. The heated substrate 19 transfers heat to the first portion 50 of the heat conducting strip 48 and the heat is conducted therealong to the second portion 52 of the heat conducting strip 52 embedded in the tobacco plug 20. The heated second portion 52 heats the tobacco volatilizing taste components therein. The heated air from the tube 18 flows through the heated tobacco entraining the volatilized taste components. The heated air, with the entrained aerosol substance and tobacco taste components, then passes through the reticulated partition 47 into the chamber 22 wherein the air is cooled.

The cooled air with the entrained aerosol substance and tobacco taste components then passes from the chamber 22, through the filter rod 24 and into the smoker's mouth. When the fuel rod 12 has burned down to the first air impermeable partition 40, it extinguishes.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the amended claims.

What is claimed is:

1. A smoking article comprising:

a generally cylindrical fuel rod;

a generally cylindrical thermal insulation section coaxially located at one end of the fuel rod;

a tube extending concentrically through the fuel rod and thermal insulation section;

a non-combustible air permeable substrate disposed within the tube;

an aerosol generating substance included in the substrate;

a tobacco plug coaxially located at the other end of the thermal insulation section opposite the fuel rod;

means defining a cooling chamber at the other end of the tobacco plug opposite the thermal insulation section; and, heat conducting means extending through the substrate in the tube longitudinally of the tube and into the tobacco plug.

2. The smoking article of claim 1, wherein the fuel rod comprises a non-tobacco fuel.

3. The smoking article of claim 1, wherein the fuel rod comprises a tobacco material.

4. The smoking article of claim 1, wherein the fuel rod comprises a circumscribing layer of heat insulation material.

5. The smoking article of claim 1, wherein the cylindrical thermal insulation section comprises a collar of thermal insulation material.

6. The smoking article of claim 1, wherein the cylindrical thermal insulation section comprises means defining an annular air space surrounding the tube.

7. The smoking article of claim 1, further comprising a heat resistant partition between the fuel rod and the thermal insulation section.

8. The smoking article of claim 1, further comprising a circumscribing sleeve of insulation material.

9. The smoking article of claim 1, wherein the concentric tube is fabricated of a heat conducting material.

10. The smoking article of claim 1, wherein the substrate fills the concentric tube.

11. The smoking article of claim 1, wherein the heat conducting means comprises a strip of heat conducting material extending substantially concentrically in the tube through the substrate and into the tobacco plug.

12. The smoking article of claim 11, wherein the strip of heat combustion material is comprised of aluminum and aluminum alloys.

13. The smoking article of claim 11, wherein the strip of heat conducting material is titanium.

14. The smoking article of claim 11, wherein the heat conducting strip is flat having a width dimension larger than a thickness dimension.

15. The smoking article of claim 14, wherein the heat conducting strip comprises:

a first section extending through the substrate;

a second section extending into the tobacco plug; and, the width dimension of the second section has a larger width dimension than the width dimension of the first section.

16. The smoking article of claim 1, further comprising a filter rod coaxially located at the cooling chamber opposite the tobacco plug.

17. The smoking article of claim 1, further comprising a reticulated partition located over the end of the tobacco rod at the interface of the tobacco rod and cooling chamber.

* * * * *